US006971979B1

(12) United States Patent
Saro

(10) Patent No.: US 6,971,979 B1
(45) Date of Patent: Dec. 6, 2005

(54) FOLDED BOX GLUING MACHINE FOR PRODUCING FOLDED BOXES FROM BLANKS

(75) Inventor: Karl Saro, Ratingen (DE)

(73) Assignee: Heidelberger Bruckmaschinen GmbH, Heidelberg (DE)

( * ) Notice: Subject to any disclaimer, the term of this patent is extended or adjusted under 35 U.S.C. 154(b) by 90 days.

(21) Appl. No.: 10/110,160

(22) PCT Filed: Aug. 25, 2000

(86) PCT No.: PCT/EP00/08294

§ 371 (c)(1),
(2), (4) Date: May 1, 2002

(87) PCT Pub. No.: WO01/24998

PCT Pub. Date: Apr. 12, 2001

(30) Foreign Application Priority Data

Oct. 6, 1999 (DE) ..... 199 48 017

(51) Int. Cl.[7] ..... B31B 1/00

(52) U.S. Cl. ..... 493/16; 493/12; 493/22; 493/82; 493/83; 83/371

(58) Field of Search ..... 493/56, 60, 64, 493/65, 66, 67, 82, 83, 86, 73, 75, 76, 79, 493/80, 81, 12, 178, 179, 180, 68, 16, 22; 83/371

(56) References Cited

U.S. PATENT DOCUMENTS 3,741,081 A * 6/1973 Lutz ..... 493/22
3,803,967 A * 4/1974 Leavens, Jr. ..... 83/371
4,917,659 A * 4/1990 Mohaupt et al. ..... 493/12
4,988,330 A * 1/1991 Bensberg ..... 493/16
5,165,314 A 11/1992 Paulson et al.
5,215,516 A * 6/1993 Stutt ..... 493/365
5,236,408 A * 8/1993 McAdam ..... 493/355
5,342,278 A 8/1994 Kurandt
5,857,395 A * 1/1999 Bohm et al. ..... 83/408
5,978,499 A * 11/1999 Tossel et al. ..... 382/141
5,993,367 A * 11/1999 Hattori et al. ..... 493/12
6,503,181 B1 * 1/2003 Pons ..... 493/130

* cited by examiner

*Primary Examiner*—Stephen F. Gerrity
*Assistant Examiner*—Christopher Harmon
(74) *Attorney, Agent, or Firm*—Herbert Dubno; Andrew Wilford

(57) ABSTRACT

Known folded box gluing machines for producing folded boxes (1) from blanks comprise—a folding station (3), in which the parts of blanks provided with an adhesive strip are folded,—an adjoining transfer station (5) which is configured as a transport device and has at least two conveyer belt pairs, each consisting of an upper and a lower belt (7, 8) and a device for ejecting defective boxes (11) and—a collection and pressing device (6), in which the flat folded boxes are pressed together, in order for the adhesive to bind. In order to eject wide boxes (11) from the machine, which have been identified as defective, the ejection device comprises the following elements:—at least one blade (12) which cuts in the direction of transport and which is mounted at the beginning of the transfer station (5) between the two conveyer belt pairs (7, 8), in such way that it can be lowered into and withdrawn from the direction of transport of the boxes (11), and a device adjacent to each longitudinal side of the transfer station (5) for laterally removing the box side sections (11.1, 11.3) from the machine, which have been separated during the longitudinal cut.

9 Claims, 2 Drawing Sheets

FOLDED BOX GLUING MACHINE FOR PRODUCING FOLDED BOXES FROM BLANKS

FIELD OF THE INVENTION

The invention relates to a folding box gluing machine for producing folded boxes from blanks with a folding station and a downstream transfer station that has at least two conveyor belt pairs each consisting of an upper belt and a lower belt and an ejection device for defective boxes, and a collection and pressing device in which the folded boxes are pressed together while the adhesive cures.

BACKGROUND OF THE INVENTION

The ejection device serves for the elimination of all identified defective boxes from the collection and pressing device, before a stream of overlapping boxes is produced at the beginning of the collection and pressing station. In the transfer station the boxes are still transported individually and are spaced apart, so that an individual box can be easily pulled out without disturbing the preceding and succeeding boxes. Defective boxes are boxes which are not sufficiently covered with adhesive, boxes with folding defects or boxes which during an identity check have not been identified as not being the type of box now being filled.

Such a generic folding box gluing machine is described in the brochure "Diana 115-3 Diana 125-3, die universellen Faltschachtel-Klebemaschinen" of the applicant. The described machine has an add-on ejector that is built into the transfer station and that ejects boxes identified as defective. The ejector for the elimination of defective boxes is mounted on a longitudinal side of the machine. It consists of a clamping roll mounted on a rotary disk which seizes the part of a defective box protruding beyond the belt pair, pulling it from the machine.

The known ejection device, by means of which a box between the conveyor belt pairs is pulled out to one side, cannot be used with large boxes more than 500 mm wide. They are not capable of pulling such large boxes from the machine at the required speed without damaging the preceding and succeeding boxes.

OBJECT OF THE INVENTION

It is therefore the object of the invention to improve a generic folding box gluing machine so that identified defective boxes of large width can be ejected from the machine.

SUMMARY OF THE INVENTION

This object is achieved in that the ejection device comprises at least one blade cutting in a conveying direction and supported at an upstream end between the two belt pairs so that it can be lowered into the conveying plane of the boxes and lifted therefrom, and downstream on each longitudinal side of the transfer station a device for lateral extraction from the machine of the side parts separated by the blade.

The ejecting device built according to the invention has the further advantage of being able to eject boxes with bilaterally inwardly folded uncovered longitudinal flaps. When such boxes are pulled out as a whole only to one side, there is a danger that one of the conveyor belts can be torn off its guide by the box. The reason for this is that as a defective box is being pulled out through one of the conveyors the inwardly folded uncovered longitudinal flap projecting past the other conveyor catches on the conveyor belts of the other conveyor, pulling its upper belt off its guides.

In a particularly advantageous embodiment with two longitudinal blades, each arranged inside next to the conveyor belt pairs, the box is separated into three parts. This results in two small lateral parts which can easily be pulled off to the respective sides and a middle part which is deflected downward by the conveyor belts. The separation into three parts has the advantage of ejecting extremely wide boxes, as well as boxes with many separate parts, for instance folded-bottom boxes. The two longitudinal cuts can be placed so that all box parts affecting the belts when they are pulled off remain on the middle part so they can be deflected downward.

The construction of the longitudinal blade as a circular blade makes it possible to cut thick boxes made of cardboard or multilayered corrugated board with high weight per surface unit. Therein:

BRIEF DESCRIPTION OF THE DRAWING

The invention is further described with the aid of the drawing representing an embodiment shown in a simplified form. Therein.

SPECIFIC DESCRIPTION

Figure 1:
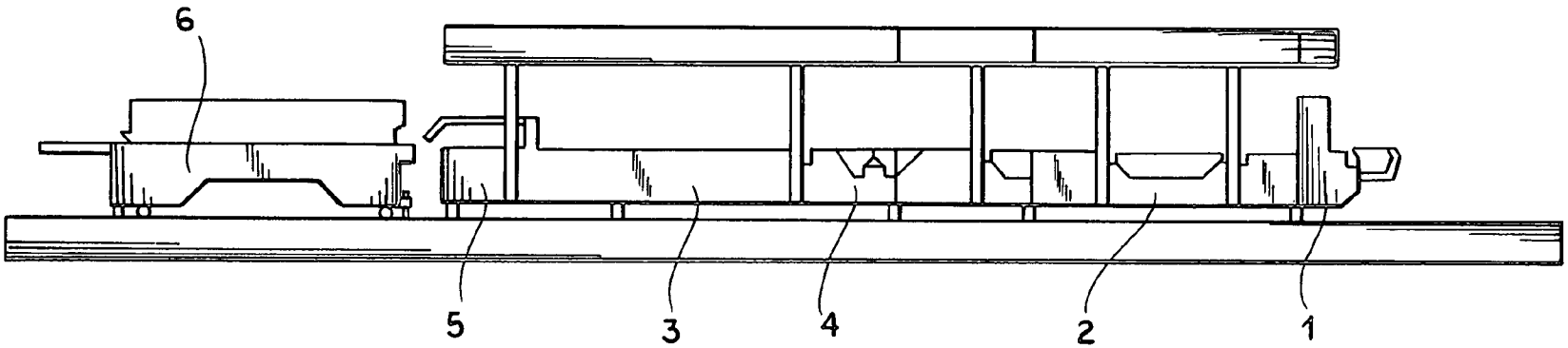
FIG. 1 shows a schematic side view of the individual stations of a folding box gluing machine.

In the conveying direction (in the figures from right to left) the folding box machine starts with a feeder 1 which picks up blanks 11 (FIG. 2) from a stack, one after the other at high speed, and feeds them individually to the downstream processing stations. The feeder 1 is followed by a preliminary creaser 2, which in the present embodiment is designed in two stages. The preliminary creaser 2 comprises folding elements serving to fold the blanks' flaps back and forth, so that the corresponding longitudinal lines are made pliable through bending through 180°. The two-stage embodiment makes it possible to break in more longitudinal and transverse lines and to perform additional folding operations.

In the case of certain box shapes two adhesive applicators are provided in the preliminary creaser 2 and serve to apply additional adhesive longitudinal strips. The next processing station downstream of the preliminary creaser 2 is a folding station 3 at whose upstream end is an applicator 4 for adhesive, usually glue. The adhesive applicator 4 has glue nozzles or glue disks by means of which adhesive is applied to the blanks in strips. Prior to folding of the flaps provided with adhesive, a check of the applied adhesives takes place. For this purpose, the adhesive strip is scanned without touching by a so-called glue seam control device serving as a sensor means. If the adhesive strip does not conform to required quality, a central controller is advised that the box is defective.

At the downstream end of the folding station 3, the folded box is checked by other sensors for folding defects. For this purpose photoelectric cells are provided which scan the length of the box. If the length of the folded box does not correspond to the predetermined format, for instance because one flap was irregularly folded, this box also is identified as defective for the central controller of the gluing machine.

Figure 2:
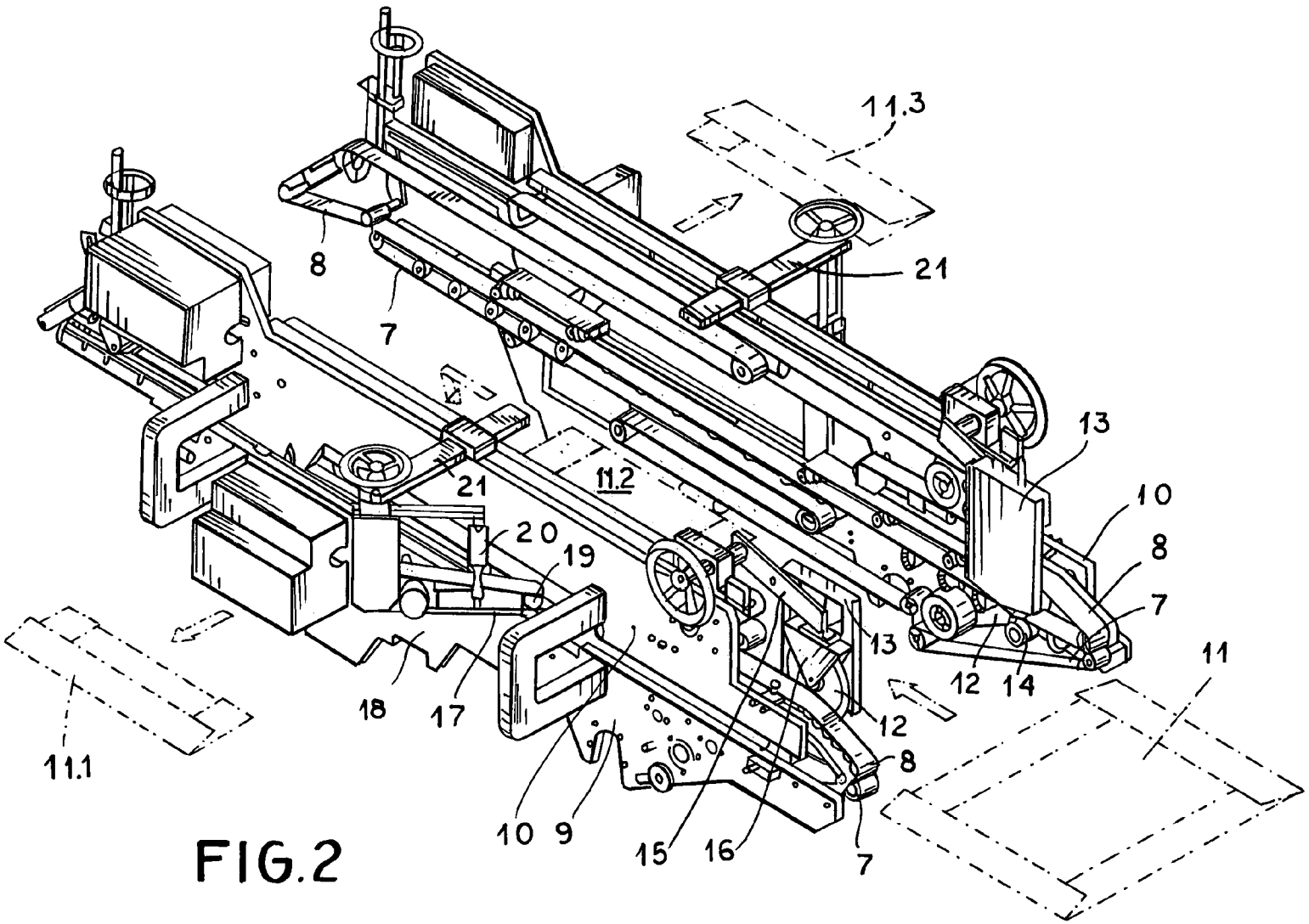
FIG. 2 shows a part of the transfer station with the ejection device in a perspective view.

The folding station 3 is immediately followed by the transfer station 5, which is shown in FIG. 2 in larger scale. The primary task of the transfer station 5 is to feed the blanks 11 with still unbonded adhesive seams to a downstream collection and pressing station 6, with all parts in the correct position. At the transfer point between the transfer station 5 and the collection and pressing station 6, a stream of overlapped folded boxes is formed. The collection and pressing station 6 has pressure belts by means of which the glued seams are kept under pressure until the adhesive has fully cured.

As a conveying device for the folded boxes the transfer station 5 comprises two pairs of conveyor belts, each consisting of a lower belt 7 and an upper belt 8. The folded blanks are transported between the upper reach of the lower belt 7 and the lower reach of the upper belt 8 at a distance from each other, the upper belts 8 holding down the folded side flaps of the blanks. The conveyor belts 7 and 8 have to be transversely adjustable in order to accommodate various blank widths. For this purpose each of the lower conveyor belts 7 is supported on a rolling carriage 9 extending in the transport direction and transversely adjustably suspended in the machine frame by means of an adjustment spindle. Correspondingly each upper conveyor belt 8 is supported on a so-called roller rail 10 that can be transversely displaced synchronously with the respective rolling carriage 9 in order to establish the desired work position of the belts 8. The belts 7 and 8 are driven by a central drive of the folding box gluing machine.

The transfer station 5 comprises an ejection device that ejects all identified defective boxes 11 from the folding box gluing machine. The construction and operation of the ejection device are described in FIG. 2.

The ejection device comprises at least one blade 12 cutting in the conveying direction and is arranged at the upstream end of the transfer station defined between the two pairs of conveyor belts 7 and 8. The blade 12 is supported in the frame of the transfer station 5 so that it can be raised and lowered. It is lowered into a use position for the cutting operation in the transport plane of the boxes 11 and lifted out of the transport plane into an inactive position.

Preferably two identically built blades 12 are each arranged inside and close to each of the pairs of a conveyor belts 7 and 8. They sever a defective box 11 into three parts 11.1, 11.2, 11.3.

Preferably the blades 12 are circular blades supported freely rotatably in respective protective housings 13 that for cutting are moved downward against a mating roller 14. Each mating roller 14 reaches peripherally from underneath up to the height of the upper conveying side of the lower conveyor belt 7, this way supporting a box 11 from below during cutting. Therefore the protective housings 13 of the circular blades 12 are each fastened to the respective roller rail 10. Each of them can be swung outward into a parked position when they are not needed. The protective housings 13 are each mounted on a lever 15, which can swing outward about the respective roller rail 10 and at the same time is transversely displaceable in order to be able to change its position with respect to the respective belts 7 and 8.

In addition the protective housings 13 are supported height-adjustable in order to be able to adjust the blades 12 to various box 5 thicknesses. This way in case of a format change, each housing 13 with the respective blade 12 is automatically positioned with the roller rail 10. The left protective housing 13 is shown partially open in FIG. 2 in order to show the mounting of the blade 12 inside the housing 13. The blade 12 is a attached to holder 15 that is vertically movable within the required lifting range by means of a pneumatic piston-cylinder unit in order to move the cutting edge of the blade 12 against the mating roller 14.

Downstream of the blades 13 in the transport direction on each longitudinal side of the transfer station 5 a device is provided for the lateral removal from the machine of the side parts 11.1 and 11.3 separated by the longitudinal cut. Each such device has a belt conveyor 17 which extends from the outside through a recess in the upper roller rail 10 into the vicinity of the conveyor belts 7 and 8. The transport direction of the belt conveyors 17 runs approximately at an angle of 45° with respect to the transport direction of the belt pairs 7 and 8 and extends outward above a smooth table 18 fastened outside to the rolling carriage 9. The upper surface of the table 17 forms a counter-surface for the lower reach of the belt conveyor 17 suspended on the roller rail 10 and supports a box part 1.11 or 11.3 that is discharged. An upstream guide roller 19 of the belt conveyor 17 can be lifted and lowered by means of a pneumatic piston-cylinder unit 20. When the guide roller 19 is lowered onto a box part 11.1 or 11.3 projecting beyond the conveyor belts 7 and 8, the belt conveyor 17 pulls the box part 11.1 or 11.3 over the table 18 outward and removes it from the machine. By raising the upstream guide roller 19, the belt conveyor 17 is inactivated. In order to be able to adjust the height of each belt conveyor 17 to the various box thicknesses, it is suspended height-adjustably from a support arm 21 fastened to the upper roller rail 10. In addition it is pivotal on the support arm 21 about a vertical axis for adjustment of its angle with respect to the transport direction.

FIG. 2 shows the preferred embodiment with two blades 12 each arranged inside next to a respective pair of conveyor belts 7 and 8. When a box 11 is identified by one of the sensor means as defective, the central controller of the folding box gluing machine determines when this box 11 will enter the transfer station 5. After the preceding good box passes the blades 12, they are lowered and cut the defective box blank 11 into three parts 11.1, 11.2, and 11.3 during passage. In case a good box blank follows, the blades 12 are raised back into the inactive position immediately after the passage of the defective box blank 11. The two belt conveyors 17 are subsequently positioned after a delay on the box parts 11.1 and 11.3 projecting outward between the pairs of conveyor belts 7 and 8 while the belt drive is turned on. In this manner the belt conveyors 17 pull the box parts 11.1 and 11.3 outward over the tables 18, thereby removing them from the machine. Preferably the belt conveyors 17 are positioned so that their angle to the transport direction is 45°, and their speed is set at 2½ times the conveying speed of the belts 7 and 8. This way during their removal the box parts 11.1 and 11.3 continue to be moved downstream in the transport direction of the conveyor belts 7 and 8 and at their conveying speed. This prevents preceding or succeeding boxes from being damaged during their run. The middle part 11.2 of the box 11 resulting from the longitudinal cuts is removed downward. It can be removed from the machine by means of a transverse conveyor provided at the bottom, or it can be comminuted by a shredder arranged at the bottom into shreds that are fed to a collection receptacle.

Instead of the two blades 12 it is possible also to provide only a single blade 12 between the pairs of conveyor belts 7 and 8, if this is acceptable for the box format to be processed, for instance when the box 11 is so small that the two parts produced by the cut can be pulled out each on one side of the machine. The arrangement with two blades 11 can also process box formats containing box parts which create problems when they are laterally pulled out from between the conveyor belts 7 and 8. The two longitudinal cuts can then be positioned so that all box parts which would hit against the belts 7 and 8 remain on the middle part 11.2 and in this way are evacuated downward. This way also complicated box shapes, particularly folded-bottom boxes, can be ejected from the machine without problems.

What is claimed is:

1. A box-gluing machine comprising:

transport means including two transversely spaced and parallel conveyors extending in a transport direction for gripping and continuously advancing a succession of box blanks in a transport direction along a path;

treatment means along an upstream portion of the path for folding and applying glue in strips to the blanks as they are advanced by the conveyors;

sensor means downstream of the treatment means for detecting defective blanks gripped by the conveyors;

a vertically displaceable blade between the conveyors downstream of the sensor means and displaceable between a use position engageable with a box blank being advanced by the conveyors and an inactive position unengageable with a box blank being advanced by the conveyors;

actuator means connected to the blade and to the sensor means for displacing the blade into the use position when a defective blank is detected and passes the blade and for thereby severing the defective box blank into at least two side parts each gripped by a respective one of the conveyors; and respective extraction means downstream of the blade and outside the belt conveyors for pulling the side parts transversely in opposite directions through the respective conveyors out of the machine.

2. The box-gluing machine defined in claim 1 wherein each of the conveyors comprises an upper belt and a lower belt, the side parts each being pinched between one of the upper belts and the respective lower belt.

3. The box-gluing machine defined in claim 1, further comprising a second vertically displaceable blade transversely spaced from the first-mentioned blade and displaceable synchronously with the first blade by the actuator means like the first blade between a use position and an inactive position, each of the blades being transversely closely juxtaposed with a respective one of the conveyors, whereby a center part can be cut from a blank by the first and second blades from between the side parts.

4. The box-gluing machine defined in claim 1 wherein the blade is a circular blade lying in a plane parallel to the direction.

5. The box-gluing machine defined in claim 1 wherein the use position is below the inactive position.

6. The box-gluing machine defined in claim 1 wherein the extraction means each include a belt extending at an acute angle to the direction away from a respective one of the conveyors.

7. The box-gluing machine defined in claim 6 wherein each of the belts extends at an angle of substantially 45° to the respective conveyor.

8. The box-gluing machine defined in claim 7 wherein each of the belts is operated at a speed equal to 21/2 times an advance speed of the blanks in the direction.

9. A box-gluing machine comprising:

transport means including first and second transversely spaced and parallel conveyors extending in a transport direction for gripping and continuously advancing a succession of box blanks in a transport direction along a path;

treatment means along an upstream portion of the path for folding and applying glue in strips to the blanks as they are advanced by the conveyors;

sensor means downstream of the treatment means for detecting defective blanks gripped by the conveyors;

respective first and second vertically displaceable and transversely spaced blades between the conveyors downstream of the sensor means and displaceable between a use position engageable with a box blank being advanced by the conveyors and an inactive position unengageable with a box blank being advanced by the conveyors;

actuator means connected to the blades and to the sensor means for displacing the blades into the use position when a defective blank is detected and passes the blades and for thereby severing the defective box blank into two side parts each gripped by a respective one of the conveyors and a center part; and respective extraction means downstream of the blade and outside the belt conveyors for pulling the side parts transversely from the respective conveyors out of the machine.

* * * * *